US007738991B2

(12) United States Patent
Klumpp

(10) Patent No.: US 7,738,991 B2
(45) Date of Patent: Jun. 15, 2010

(54) METHOD FOR PRODUCING A FOOTLET

(75) Inventor: Sascha Klumpp, Coldrerio (CH)

(73) Assignee: Hugo Boss Trade Mark Management GmbH & Co. KG, Metzigen (DE)

( * ) Notice: Subject to any disclaimer, the term of this patent is extended or adjusted under 35 U.S.C. 154(b) by 0 days.

(21) Appl. No.: 12/488,319

(22) Filed: Jun. 19, 2009

(65) Prior Publication Data

US 2009/0314039 A1 Dec. 24, 2009

(30) Foreign Application Priority Data

Jun. 20, 2008 (EP) ..... 08158721

(51) Int. Cl.
*D04B 9/46* (2006.01)
*G06F 19/00* (2006.01)

(52) U.S. Cl. ..... 700/141; 66/185

(58) Field of Classification Search ..... 700/130, 700/131, 141, 140; 66/8, 185–188
See application file for complete search history.

(56) References Cited

U.S. PATENT DOCUMENTS

| | | | | |
|---|---|---|---|---|
| 3,059,458 | A | 10/1962 | Sarbo | |
| 3,600,909 | A * | 8/1971 | Kaplan | 66/171 |
| 3,603,116 | A * | 9/1971 | Turini | 66/187 |
| 4,069,090 | A | 1/1978 | Boyer | |
| 5,560,226 | A * | 10/1996 | Throneburg | 66/185 |
| 5,603,232 | A * | 2/1997 | Throneburg | 66/185 |
| 5,791,163 | A * | 8/1998 | Throneburg | 66/178 R |
| 6,173,589 | B1 * | 1/2001 | Hayes et al. | 66/171 |
| 6,178,785 | B1 * | 1/2001 | Samata | 66/186 |
| 6,415,632 | B1 * | 7/2002 | Vesnaver | 66/19 |
| 6,735,988 | B1 * | 5/2004 | Honeycutt | 66/185 |
| 7,191,622 | B1 * | 3/2007 | Walker et al. | 66/180 |
| 7,460,926 | B2 * | 12/2008 | Okamoto | 700/141 |

FOREIGN PATENT DOCUMENTS

| | | | |
|---|---|---|---|
| DE | 400392 | C | 8/1924 |
| EP | 0 632 972 | A1 | 1/1995 |
| WO | 2000/019846 | A1 | 4/2000 |

* cited by examiner

*Primary Examiner*—Danny Worrell
(74) *Attorney, Agent, or Firm*—Fitch, Even, Tabin & Flannery

(57) ABSTRACT

The present invention relates to a method for producing a footlet on a circular knitting machine including at least a first (S1) and a second knitting system (S2), wherein a first quadrant is associated with the first knitting system (S1) and a second quadrant is associated with the second knitting system (S2), including the following steps: a) knitting an access opening (12) of the footlet, wherein at least a first (B1), a second (B2) and a third region (B3) are formed in the transverse direction of the access opening (12), wherein a first (A1), a second (A2) and a third section (A3) are formed in the longitudinal direction of the access opening (12), including the following sub-steps: a1) knitting the second region (B2) and the third region (B3) of the first section (A1); a2) knitting the second region (B2) and the third region (B3) of the second section (A2); and a3) knitting the second region (B2) and the third region (B3) of the third section (A3). Moreover, the invention includes a footlet produced by the method, a programmable circular knitting machine, the programming of which is configured to perform such a method, as well as a computer program product for a circular knitting machine, which is configured to perform such a method.

17 Claims, 3 Drawing Sheets

METHOD FOR PRODUCING A FOOTLET

CROSS REFERENCE TO RELATED APPLICATIONS

This application claims priority to European Patent Application No. EP08158721, filed Jun. 20, 2008, which is incorporated by reference herein in its entirety.

BACKGROUND OF THE INVENTION

Since a few years, footlets become increasingly popular. They are worn particularly willingly together with sports shoes and sneakers and offer the advantage that externally there is conveyed the impression that the wearer would wear the shoe directly on the skin, but in fact this is not the case. Rather, the wearer achieves this desired optical effect and yet achieves the advantage that there is fabric between his skin and the shoe, which absorbs sweat as well as reduces smell of sweat and friction. Thereby, a comfortable feeling of wearing with aesthetically attractive look results.

By a circular knitting machine, a knitting machine is to be understood, in which the machine constituting elements, i.e. especially needles and sinkers, are disposed circularly. In circular machine knitting, a thread is inserted into the latch needles, the needle is closed and the thread is pulled through the mesh, which was already on the needle. Subsequently, the needle is again opened and pushed upwards, i.e. expelled. The sinkers disposed between the needles, substantially have the shape of a lying U. It is their object to maintain the finished knitted meshes horizontally on the same level. The knitted fabric comes to lie in the interior of one of these Us before it is withdrawn and rolled up in the lower part of the circular knitting machine. In knitting, the needles travel standing upright in a circle. In machine knitting, a thread supply as constant as possible is important. This is accomplished by so-called thread guides in machine knitting. Of these, several are disposed topmost on the circular knitting machine corresponding to the number of threads to be processed simultaneously.

Further important characteristics of circular knitting machines are the number of the knitting systems realized thereon, the diameter of the circular knitting machine as well as the fineness thereof, i.e. for example the number of needles per inch.

In known footlets, for example, the leg termination, i.e. the access opening, is finished. Therein, first, a tube is knitted, the opening is cut out and subsequently a band including a rubber band is seamed.

In the known footlets, the circumstance it is to be considered disadvantageous that they often have the tendency to slip into the shoe with increasing wearing duration. It results in an unpleasant feeling of wearing and results in chafing due to friction, in particular at the transition footlet-foot.

The present invention relates to a method for producing a footlet on a circular knitting machine including at least a first and a second knitting system, wherein a first quadrant is associated with the first knitting system and a second quadrant is associated with the second knitting system. Moreover, it relates to a footlet having been produced by a corresponding method, a programmable circular knitting machine, the programming of which is configured to perform such a method, as well as a computer program product for a circular knitting machine, which is configured to perform such a method. By so-called footlets, in the first approximation, socks are to be understood, which lack the tubular part, which is intended to cover the lower part of the calf.

Therefore, the object of the present invention is to develop a generic method such that a footlet can be produced therewith, which has a considerably lower tendency to slip into the shoe upon wearing. Further, the object is to provide a corresponding footlet, a correspondingly programmable circular knitting machine as well as a corresponding computer program product.

These objects are solved by a method having the features of claim 1, a footlet having the features of claim 15, a programmable circular knitting machine having the features of claim 16 as well as by a computer program product having the features of claim 17.

The present invention is based on the realization that these objects can be solved if the access opening is knitted such that it is formed slit-shaped, wherein the knitting operation is to be configured such that there is provided the possibility to knit the region surrounding the slit, i.e. the actual access opening for the foot, with another thread than the surrounding knitted fabric. By this measure, then, threads can be used for the material surrounding the slit, which are in particular characterized by a higher elasticity than the threads used for the remaining knitted fabric.

By the method according to the invention, a footlet can be produced, which is characterized by an access opening as narrow as possible, which preferably is terminated by a thread with high elasticity. Thereby, a footlet is provided, which is not visible outside of the shoe and reliably counteracts slipping into the shoe. This results in superior wearing comfort, in excellent protection against chafing and in a permanently pleasant feeling of wearing.

Accordingly, in the method according to the invention, the step of knitting the access opening of the footlet, wherein at least a first, a second and a third region are formed in transverse direction of the access opening, wherein a first, a second and a third section are formed in the longitudinal direction of the access opening, includes the following sub-steps: first, the second and the third region of the first section are knitted, within which the knitting system knitting the second region engages with the knitting system knitting the third region, wherein the knitting system knitting the first region engages with the knitting system knitting the second and the third region. Subsequently, the second and the third region of the second section is knitted, within which the knitting system knitting the second region does not engage with the knitting system knitting the third region, wherein the knitting system knitting the first region engages with the knitting system knitting the second and the third region. Finally, the second and the third region of the third section are knitted, within which the knitting system knitting the second region engages with the knitting system knitting the third region, wherein the knitting system knitting the first region engages with the knitting system knitting the second and the third region.

In other words, first, the knitting systems knitting the second and the third region engage with each other, wherein the region facing the heel is knitted before the access opening. For knitting the slit-shaped access opening, these two knitting systems then do not engage with each other, and finally, for knitting the tip-side region above the access opening, then, the mentioned two knitting systems again engage with each other. The third knitting system involved in knitting the access opening knits the first region located outside of the second and the third region, i.e. in top view viewed with the tip towards the top the left side of the footlet, the sole and the right side of the footlet.

In a preferred embodiment, in which the circular knitting machine only includes a first and a second knitting system, in the first, second and third section, the knitting system knitting the first region is the second knitting system, the knitting system knitting the second region is the second knitting system and the knitting system knitting the third region is also the second knitting system, wherein the first region is knitted with a first thread type, wherein the second region is knitted with a second thread type and wherein the third region is knitted with a third thread type. This embodiment is associated with a plurality of thread guide changes, however, it already allows the performance of the method according to the invention on a circular knitting machine with only two knitting systems.

In a further preferred embodiment, the circular knitting machine includes a first, a second and a third knitting system, wherein a third quadrant is associated with the third knitting system, wherein in the first, second and third section, the knitting system knitting the first region is the second knitting system, the knitting system knitting the second region is the second knitting system, and the knitting system knitting the third region is the third knitting system, wherein the first region is knitted with a first thread type, wherein the second region is knitted with a second thread type and wherein the third region is knitted with a third thread type. This variant is characterized in that it already allows the performance of the method according to the invention on a circular knitting machine with only three knitting systems and gets along with considerably less thread guide changes with respect to the previously mentioned preferred embodiment. In particular, the circular knitting machine even has to include less thread guides.

In a particularly preferred embodiment, the circular knitting machine includes a first, a second, a third and a fourth knitting system, wherein a third quadrant is associated with the third knitting system and a fourth quadrant is associated with the fourth knitting system, wherein in the first, second and third section, the knitting system knitting the first region is the second knitting system, the knitting system knitting the second region is the fourth knitting system and the knitting system knitting the third region is the third knitting system, wherein the first region is knitted with a first thread type, wherein the second region is knitted with a second thread type, and wherein the third region is knitted with a third thread type. This embodiment gets along with a minimum of thread guide changes and thus also with a minimum of thread guides to be provided. However, it requires a circular knitting machine with at least four knitting systems.

It is preferred if in the first, second and third section, the second and the third thread type have a greater elasticity than the first thread type. By a great elasticity, a particularly secure retention of the footlet on the foot is achieved, and thus slipping into the shoe is prevented particularly reliably.

Furthermore, it is preferred if in the first, second and third section, the first, second and third region are knitted in oscillatory motion.

Preferably, within the second section, in each row, the number of meshes in the second region corresponds to the number of meshes in the third region. Thereby, a slit opening results, in which the elastic termination is formed symmetrically.

A preferred development is characterized in that at the beginning of the first sub-step for knitting the access opening, in each row, the sum of the number of meshes in the second and in the third region comprises a first number m1, and towards the end of the first sub-step a second number m2, wherein the second number m2 is less than or equal to the first number m1. If the second number m2 is actually less than the first number m1, thus, thereby, the distance over which the second and the third region are contacted with the surrounding region, i.e. connected to it, is formed particularly long, whereby a particularly secure protection against tearing-out can be provided. The footlet produced thereby is characterized by a considerably increased durability, an even better elasticity and therefore an even better wearing comfort.

Then, within the second section, in each row, the number of meshes in the second region and the number of meshes in the third region are particularly preferred m2/2.

Appropriate measures can also be provided at the upper end of the access opening. Thus, at the beginning of the third sub-step of the production of the region of the access opening, in each row, the sum of the number of meshes in the second and in the third region can comprise a third number m3, and towards the end of the third sub-step a fourth number m4, wherein the fourth number m4 is grater than or equal to the third number m3. Thereby, a correspondingly increased security against tearing-out is also provided at the tip-side end of the access opening. However, the danger of tearing-out is generally reduced there, since the instep of the foot passes substantially flat in contrast to the heel region.

Preferably, before knitting the region of the access opening, a heel of the footlet is knitted. Therein, first, a first section is knitted-on in circular movement with at least the first knitting system, and subsequently, a second section is knitted with the first knitting system by increasing and decreasing for forming the actual heel.

Furthermore, preferably, after knitting the region of the access opening, a tip of the footlet is knitted. Therein, first, a first section is knitted in circular movement with at least the first knitting system, subsequently, a second section is knitted with the first knitting system by increasing and decreasing, and finally a third section is knitted in circular movement with at least the first knitting system.

It can be provided that between knitting the first section and the second section of the tip of the footlet, a fourth section is knitted with a thread, which differs from the thread used for the first and the second section of the tip, in particular with respect to its color. Thereby, in particularly simple manner, the tip of the footlet can be identified permanently in order to exclude confusions with the heel and thus to ensure putting on of the footlet correct in side. The danger of tearing-out of the second and the third region in the region of the access opening or of tearing-in of the region, in which the knitting system knitting the second and the third region engage with each other, is considerably reduced.

Further preferred embodiments appear from the dependent claims.

The preferred embodiments presented with respect to the method according to the invention and the advantages thereof apply correspondingly, if applicable, to a footlet according to the invention, a programmable circular knitting machine according to the invention as well as a computer program product according to the invention for a circular knitting machine.

BRIEF DESCRIPTION OF THE DRAWINGS

In the following, embodiments of the present invention are described in more detail with reference to the attached drawings. There show.

DETAILED DESCRIPTION

Figure 1:
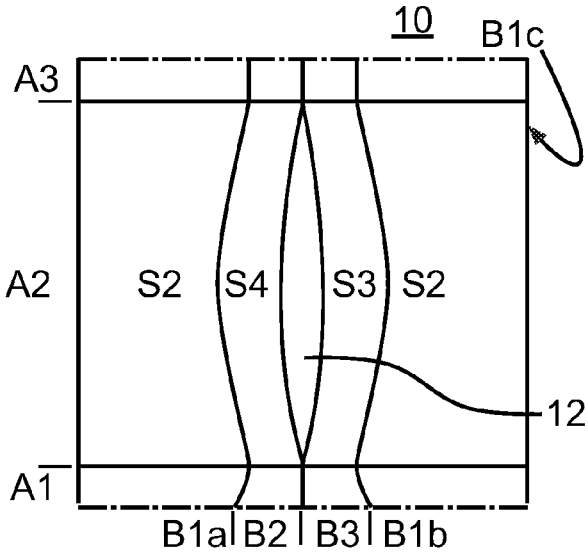
FIG. 1 in schematic representation the region of the access opening according to a first embodiment of a footlet according to the invention.

FIG. 1 shows in schematic representation the region 10 of the access opening 12 of a footlet according to the invention according to a first embodiment. In the representation, the region 10 of the access opening 12 is divided in three sections A1, A2 and A3 in the longitudinal direction, in four regions B1*a*, B2, B3, B1*b* in the transverse direction. A region B1*c* not visible represents the sole region located between the regions B1*a* and B1*b*. The section A1 faces the heel, while the section A3 faces the tip. According to the embodiment of FIG. 1, the regions B1*a*, B1*b* and B1*c* are knitted by the second knitting system S2 of a circular knitting machine with four knitting systems S2, S2, S3 and S4. The region B2 is knitted by the fourth knitting system S4 and the region B3 is knitted by the third knitting system S3. While the fourth S4 and the third knitting system S3 engage with each other in the sections A1 and A3, they do it not in the section A2 such that the access opening 12 arises. At the lower end of the section A1, the number of meshes of the regions B2 and B3 knitted by the fourth S4 and the third knitting system S3 is greater than at the upper end of the section A1. In the section A3, the number of meshes of the region B2 knitted by the fourth knitting system S4 and of the region B3 knitted by the third knitting system S3 is constant per row over the entire section A3. In the section A2, the number of meshes per row knitted by the fourth knitting system S4 corresponds to the number of meshes per row knitted by the third knitting system S3. The second knitting system S2 oscillates entirely through, i.e. also across the sole, and the knitted fabric knitted by it is linked to the knitted fabric knitted by the fourth knitting system S4 on the one side, and linked to the knitted fabric knitted by the third knitting system S3 on the other side.

Figure 2:
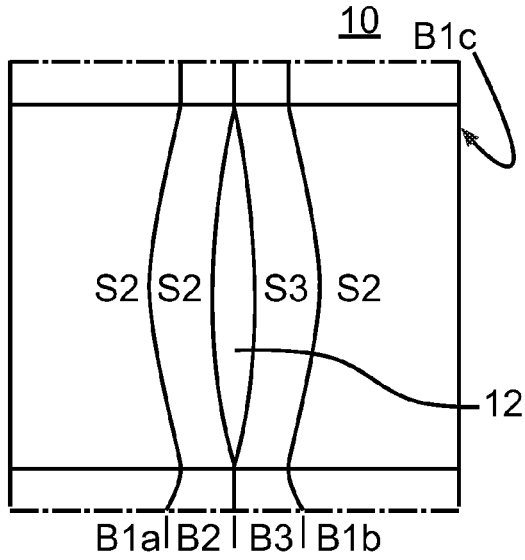
FIG. 2 in schematic representation the region of the access opening according to a second embodiment of a footlet according to the invention.

According to the embodiment illustrated in FIG. 2, for knitting the region 10 of the access opening 12, only a second S2 and a third knitting system S3 of a circular knitting machine with three knitting systems S1, S2 and S3 is used. The representation of FIG. 2 differs from the representation of FIG. 1 in that the region knitted by the fourth knitting system S4, see FIG. 1, is now also knitted by the second knitting system S2 according to FIG. 2. For this, before knitting the region B2, a thread guide change is to be performed respectively. Naturally, the employed circular knitting machine has to provide a corresponding number of thread guides.

Figure 3:
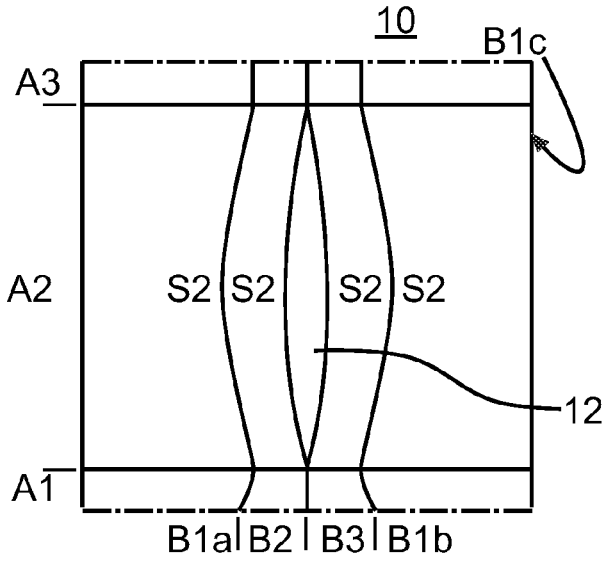
FIG. 3 in schematic representation the region of the access opening according to a third embodiment of a footlet according to the invention.

According to the embodiment illustrated in FIG. 3, in distinction from the embodiment of FIG. 2, now, the region B3 is also knitted by the second knitting system S2. For this, a further thread guide change is to be accomplished respectively. The circular knitting machine has to include a further thread guide.

Figure 4:
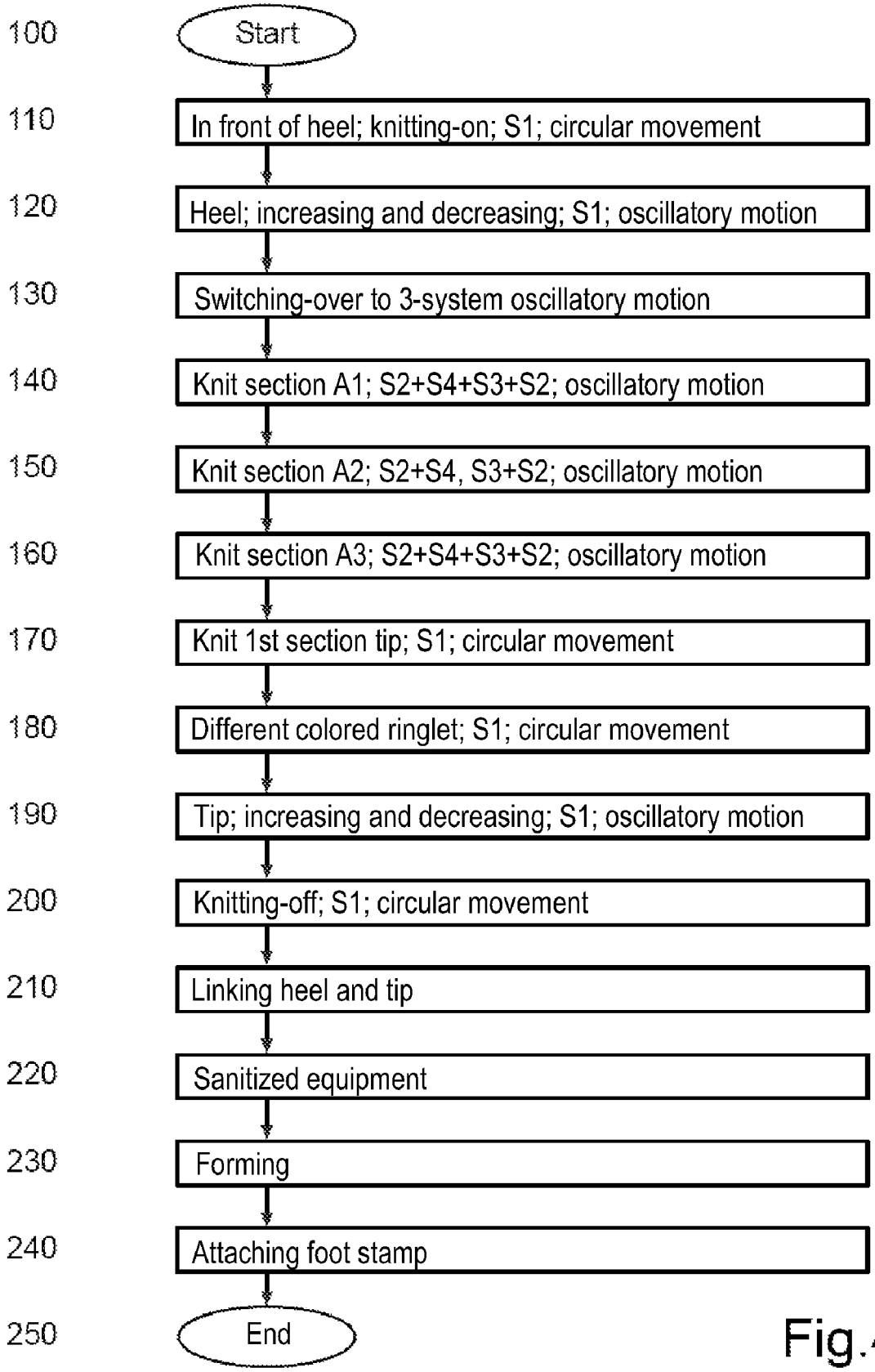
FIG. 4 in schematic representation a signal flow diagram for an embodiment of a method according to the invention.

FIG. 4 shows in schematic representation a signal flow graph for an embodiment of a method according to the invention. It corresponds to the embodiment of FIG. 1, in which the circular knitting machine has four knitting systems S1, S2, S3 and S4.

The method begins in step 100. In step 110, first, the region in front of the heel is knitted in circular movement with the first knitting system S1 over a region of ca. 2 cm.

In step 120, it is switched over to the oscillatory motion in order to knit the actual heel by increasing and decreasing in the first knitting system S1, i.e. the basic system, wherein, preferably, the thread is reinforced with thicker polyamide at the same time.

In step 130, after oscillation of the heel, it is switched over to the three-system oscillatory motion, i.e. an oscillatory motion, in which the three knitting systems S2, S3 and S4 are involved.

Subsequently, in step 140, first, the section A1 is knitted using the knitting systems S2, S4 and S3, wherein the fourth S4 and the third knitting system S3 cooperate.

In step 150, the section A2 is knitted, in which the fourth S4 and the third knitting system S3 do not cooperate.

In step 160, the section A3 is knitted, in which now the fourth S4 and the third knitting system S3 again cooperate.

In Step 170, the first section of the tip is knitted using the first knitting system S1 in circular movement.

In step 180, a different colored ringlet 16 is knitted with the first knitting system S1 in circular movement, which in particular serves for identifying the tip.

In step 190, the second section of the tip is knitted with increasing and decreasing and using the first knitting system S1 in oscillatory motion.

In step 200, the third section of the tip is knitted off by knitting using the first knitting system S1 in circular movement.

Subsequently, in step 210, the heel and the tip are manually linked to close the heel and the tip with due meshes.

In step 220, the footlet is provided with a sanitized equipment in tumbling and drying.

In step 230, the footlet is exactly formed to a presettable size, and in step 240, a foot stamp for example indicating the manufacturer is attached.

The method ends in step 250.

In a preferred development of the method, a logo is knitted-in between step 170 and step 180.

Figure 5:
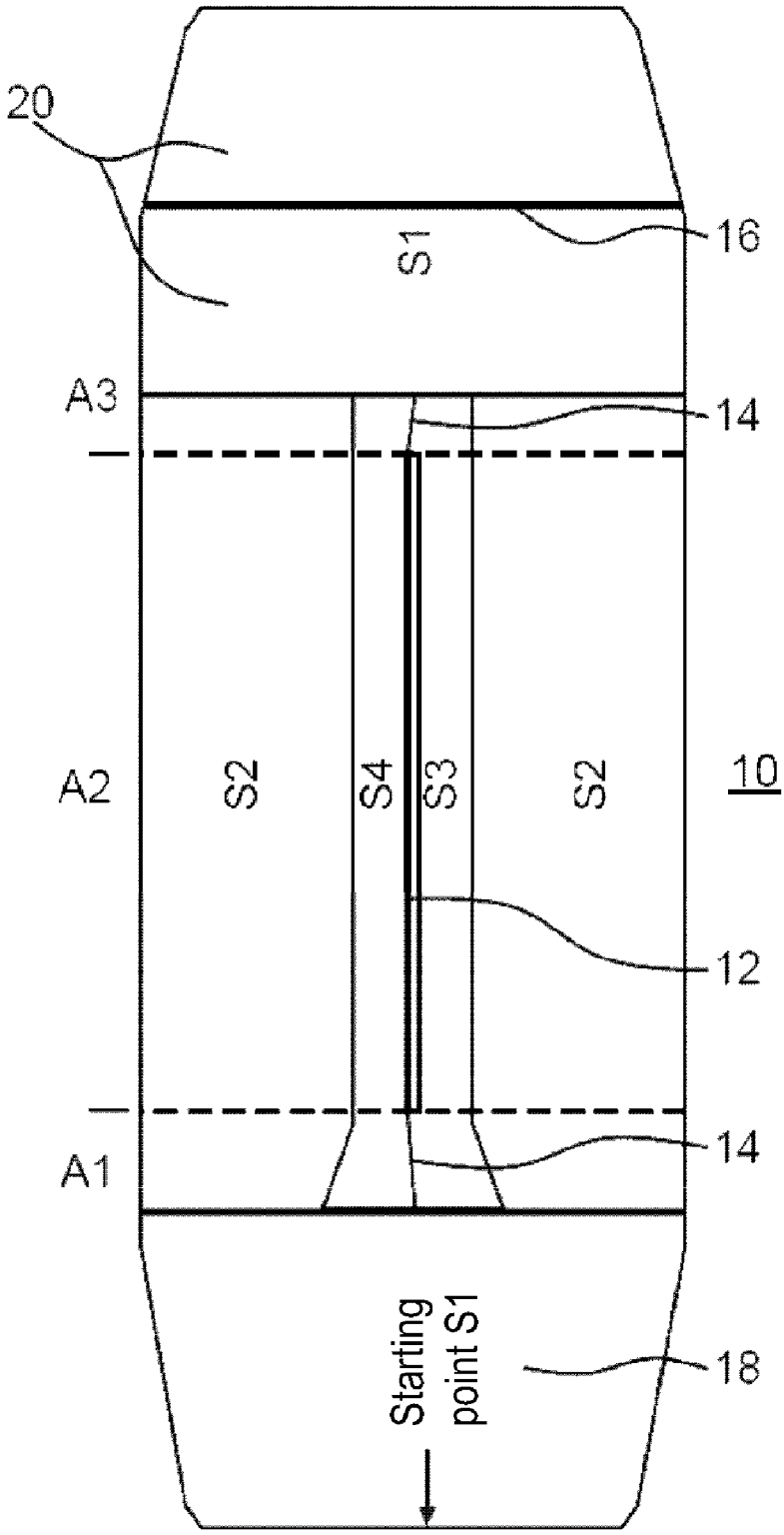
FIG. 5 a schematic representation of a footlet according to the invention, including heel and tip region, in which the region of the access opening corresponds to the representation in FIG. 1.

For clarification, FIG. 5 shows a footlet according to the invention, as it presents itself after step 250, wherein the footlet has been knitted according to the method of FIG. 4, i.e. using a four-system circular knitting machine. In the first A1 and third section A3 of the region 10 of the access opening 12, a curled up mesh 14 is clearly recognizable, which results due to the cooperation of the third S3 with the fourth knitting system S4. Furthermore, the ringlet 16 disposed in the tip region 20 is seen. The heel region bears the reference character 18.

A circular knitting machine suitable for performing the method according to the invention with corresponding programming is the Magica of the company Colosio. Therein, a Magica with a diameter of 3¾ inch having 120 needles is particularly preferred. A greater fineness would result on a version with 156 needles, a reduced fineness on a version with 96 or 84 needles. Besides four knitting systems, the mentioned Magica of the company Colosio has an electronic control by an on-board microprocessor as well as 18 electro-pneumatic thread guides and a rubber thread guide electronically controlled via a furnisher. It includes eight groups of sensors for a needle/needle selection and allows knitting of the heel and the tip without decreasing finger.

Moreover, it has a diskette drive or an interface, respectively, in particular an USB interface, via which a knitting program can be copied into a memory of the circular knitting machine, from which it is then executed.

For knitting the second B2 and the third region B3, preferably, the following yarn is used: 200 dtex EL plus 78/1 PA (wrapped). For the first region as well as for the tip and the heel, preferably, the following yarn is used: 2×Nm 50/1 CO plus 20/70 PA/EL (85 dtex elastane). Therein, the abbreviation EL signifies elastane, Nm signifies metric count (yarn thickness), PA signifies polyamide, CO signifies cotton, dtex signifies decitex (yarn thickness), wherein 1 tex=$\frac{1}{1000}$*1/Nm.

Generally, for the second B2 and the third region B3, preferably, an elastane thread is used, which is wrapped with polyamide. Thereby, higher elasticity as well as an increased tensioning force with respect to a cotton thread results. For the remaining knitted fabric, preferably, a cotton thread plated with polyamide is used. Therein, the outside is knitted with cotton and the inside is knitted with polyamide.

At the beginning of the region B2 and of the region B3 in the section A1, the width is preferably 11 meshes. They are decreased to 5 meshes up to the end of the section 1.

The invention claimed is:

1. A method for producing a footlet on a circular knitting machine including at least a first and a second knitting system, wherein a first quadrant is associated with the first knitting system and a second quadrant is associated with the second knitting system, the method comprising:

a) knitting an access opening of the footlet, wherein at least a first, a second and a third region are formed in the transverse direction of the access opening, wherein a first, a second and a third section are formed in the longitudinal direction of the access opening, including the following sub-steps:

a1) knitting the second region and the third region of the first section, within which the knitting system knitting the second region engages with the knitting system knitting the third region, wherein the knitting system knitting the first region engages with the knitting system knitting the second and the third region;

a2) knitting the second region and the third region of the second section, within which the knitting system knitting the second region does not engage with the knitting system knitting the third region, wherein the knitting system knitting the first region engages with the knitting system knitting the second and the third region; and a3) knitting the second region and the third region of the third section, within which the knitting system knitting the second region engages with the knitting system knitting the third region, wherein the knitting system knitting the first region engages with the knitting system knitting the second and the third region.

2. The method according to claim 1, wherein the circular knitting machine includes a first and a second knitting system, wherein-in the first, second and third section, the knitting system knitting the first region is the second knitting system, the knitting system knitting the second region is the second knitting system, and the knitting system knitting the third region is the second knitting system, wherein the first region is knitted with a first thread type, wherein the second region is knitted with a second thread type, and wherein the third region is knitted with a third thread type.

3. The method according to claim 1, wherein the circular knitting machine includes a first, a second and a third knitting system, wherein a third quadrant is associated with the third knitting system, wherein in the first, second and third section, the knitting system knitting the first region is the second knitting system, the knitting system knitting the second region is the second knitting system, and the knitting system knitting the third region is the third knitting system, wherein the first region is knitted with a first thread type, wherein the second region is knitted with a second thread type, and wherein the third region is knitted with a third thread type.

4. The method according to claim 1, wherein the circular knitting machine includes a first, a second, a third and a fourth knitting system, wherein a third quadrant is associated with the third knitting system and a fourth quadrant is associated with the fourth knitting system, wherein in the first, second and third section, the knitting system knitting the first region is the second knitting system, the knitting system knitting the second region is the fourth knitting system, and the knitting system knitting the third region is the third knitting system, wherein the first region is knitted with a first thread type, wherein the second region is knitted with a second thread type, and wherein the third region is knitted with a third thread type.

5. The method according to claim 2, wherein in the first, second and third section, the second and the third thread type have a greater elasticity than the first thread type.

6. The method according to claim 1, wherein in the first, second and third section, the first, second and third region are knitted in oscillatory movement.

7. The method according to claim 1, wherein within the second section, in each row, the number of meshes in the second region corresponds to the number of meshes in the third region.

8. The method according to claim 1, wherein at the beginning of step a1), in each row, the sum of the numbers of meshes in the second and in the third region comprises a first number m1, and towards the end of step a1) a second number m2, wherein the second number m2 is less than or equal to the first number m1.

9. The method according to claim 8, wherein at the beginning of step a1), in each row, the sum of the numbers of meshes in the second and in the third region comprises a first number m1, and towards the end of step a1) a second number m2, wherein the second number m2 is less than the first number m1.

10. The method according to claim 9, wherein within the second section, in each row, the number of meshes in the second region and the number of meshes in the third region are m2/2.

11. The method according to claim 1, wherein at the beginning of step a3), in each row, the sum of the numbers of meshes in the second and in the third region comprises a third number m3, and towards the end of step a3) a fourth number m4, wherein the fourth number m4 is greater than or equal to the third number m3.

12. The method according to claim 1, wherein before step a), the following step b) is carried out:

b) knitting a heel of the footlet, including the following sub-steps:

b1) knitting-on a first section with at least the first knitting system in circular motion; and b2) knitting a second section with the first knitting system by increasing and decreasing.

13. The method according to claim 1, wherein after step a), the following step c) is carried out:

c) knitting a tip of the footlet, including the following sub-steps:

c1) knitting a first section with at least the first knitting system in circular motion;

c2) knitting a second section with the first knitting system by increasing and decreasing; and c3) knitting a third section with at least the first knitting system in circular motion.

14. The method according to claim 13, wherein between step c1) and c2) a fourth section is knitted with a thread, which differs from the thread used for the first and the second section of the tip, in particular with respect to its color.

15. A footlet with an access opening produced according to a method according to claim 1.

16. A programmable circular knitting machine including at least a first and a second knitting system, wherein a first quadrant is associated with the first knitting system and a second quadrant is associated with the second knitting system, wherein the programming is configured to effect the performance of the following steps for producing an access opening (12) of a footlet:

a) knitting an access opening of the footlet, wherein at least a first, a second and a third region are formed in the transverse direction of the access opening, wherein a first, a second and a third section are formed in the longitudinal direction of the access opening, including the following sub-steps:

a1) knitting the second region and the third region of the first section, within which the knitting system knitting the second region engages with the knitting system knitting the third region, wherein the knitting system knitting the first region engages with the knitting system knitting the second and the third region;

a2) knitting the second region and the third region of the second section, within which the knitting system knitting the second region does not engage with the knitting system knitting the third region, wherein the knitting system knitting the first region engages with the knitting system knitting the second and the third region; and a3) knitting the second region and the third region of the third section, within which the knitting system knitting the second region engages with the knitting system knitting the third region, wherein the knitting system knitting the first region engages with the knitting system knitting the second and the third region.

17. A computer program product for a circular knitting machine, the computer program product encoded on a computer readable memory, and the computer program product configured to perform a method for producing a footlet on a circular knitting machine including at least a first and a second knitting system, wherein a first quadrant is associated with the first knitting system and a second quadrant is associated with the second knitting system, the method comprising:

a) knitting an access opening of the footlet, wherein at least a first, a second and a third region are formed in the transverse direction of the access opening, wherein a first, a second and a third section are formed in the longitudinal direction of the access opening, including the following sub-steps:

a1) knitting the second region and the third region of the first section, within which the knitting system knitting the second region engages with the knitting system knitting the third region, wherein the knitting system knitting the first region engages with the knitting system knitting the second and the third region;

a2) knitting the second region and the third region of the second section, within which the knitting system knitting the second region does not engage with the knitting system knitting the third region, wherein the knitting system knitting the first region engages with the knitting system knitting the second and the third region; and a3) knitting the second region and the third region of the third section, within which the knitting system knitting the second region engages with the knitting system knitting the third region, wherein the knitting system knitting the first region engages with the knitting system knitting the second and the third region.

* * * * *